US005657922A

United States Patent [19]

Lowery et al.

[11] Patent Number: 5,657,922

[45] Date of Patent: Aug. 19, 1997

[54] MACHINE AND PROCESS FOR FORMING TAPERED OR CYLINDRICAL UTILITY POLES FROM FLAT SHEET METAL

[76] Inventors: Richard L. Lowery, 10 Pecan Dr., Stillwater, Okla. 74075; Josh David Inda, Rte. 3, Box 166-B, Perry, Okla. 73077; Tim Mitchell Hoberock, 10460 Edna St., Boise, Id. 83704

[21] Appl. No.: 502,570

[22] Filed: Jul. 14, 1995

[51] Int. Cl.[6] ..... B23K 28/02; B21C 37/04

[52] U.S. Cl. ..... 228/144; 72/368; 228/151

[58] Field of Search ..... 228/144, 151; 72/368

[56] References Cited

U.S. PATENT DOCUMENTS

| | | | |
|---|---|---|---|
| 1,805,283 | 5/1931 | Hammerstrom | 228/151 |
| 1,879,078 | 9/1932 | Carlsen | 72/368 |
| 2,500,813 | 3/1950 | Fritsch | 29/157 |
| 3,452,424 | 7/1969 | Morris | 29/477.7 |
| 3,754,431 | 8/1973 | Ramdohr | 72/416 |
| 3,802,239 | 4/1974 | Karmann et al. | 72/51 |
| 3,802,240 | 4/1974 | Thamasett | 72/87 |
| 3,920,173 | 11/1975 | Salata | 228/147 |
| 4,622,841 | 11/1986 | Yoshida | 72/367 |
| 4,846,392 | 7/1989 | Hinshaw | 228/147 |
| 4,971,239 | 11/1990 | Tyler et al. | 228/146 |
| 5,011,064 | 4/1991 | Fuss | 228/151 |

*Primary Examiner*—Kenneth J. Ramsey

*Attorney, Agent, or Firm*—Head Johnson & Kachigian

[57] ABSTRACT

A method and apparatus for producing tapered, cylindrical poles from trapezoidal metal strips. The process is comprised of the steps of curling or pre-forming a trapezoidal blank, then forming the pre-formed blank into a tubular shape by means of a shovel die. The tubular shaped blank is then welded along a longitudinal seam such that a tubular pipe is formed. The resulting tapered cylindrical poles are typically used around highways, parking lots and playing fields to support lights or signs. The process can also be used to form thin wall cylindrical pipes.

32 Claims, 9 Drawing Sheets

MACHINE AND PROCESS FOR FORMING TAPERED OR CYLINDRICAL UTILITY POLES FROM FLAT SHEET METAL

BACKGROUND OF THE INVENTION

1. Field of the Invention

The present invention relates to a machine and process for bending flat sheet metal into the form of a round tapered cylindrical tube, pole, or pipe that is commonly found around highways, parking lots and playing fields to support lights or signs.

2. Background

The use of metal poles for the structural support and placement of devices used by the utility and lighting industries has been a common practice for many years. Tapered metal poles in particular are widely implemented for the structural support of roadway illumination, vehicle parking lot illumination, and traffic signals. Metal poles are preferred over wooden poles for their structural properties, durability and aesthetic appeal. Other materials such as composites can be made to achieve similar structural properties as steel poles but require expensive adhesives to secure base plates and mounting fixtures to the parent pole.

Tapered metal poles are typically constructed in lengths ranging from 20 to 50 feet and typically have wall thicknesses that vary, according to length and loading conditions, from 0.12 inches to 0.25 inches. These poles typically have an apex diameter of 4 inches and a base diameter which is dictated by the length and taper. A preferred "standard tapered tube" is typically a hollow conical tube which typically has a 0.14 inch per foot diameter taper to a small diameter of about four inches, little to no surface defects, and one welded longitudinal seam. The tube should have the same diameter at the top (the small diameter) regardless of the length or of the bottom diameter.

The American Society for the Testing of Metals, ASTM, has developed a standard for tapered steel tubes implemented for structural use, referred to as A595. The specification delineates the material composition, dimensional tolerances and testing procedures required to meet the A595 standard.

Several methods can be used in the construction of tapered metal poles. Most processes currently use a complicated series of forming operations and often require additional sizing to meet the ASTM standard for dimensional tolerances. As can be expected, the purchase price of a tapered round metal pole is reflected by the complexity of the forming method used in its manufacture. Thus, incentive for the development of a new mechanism which can produce round tapered metal poles faster and more economically than current market sources can provide is of great interest to the lighting and utility companies.

There exists a variety of manufacturing processes available to form tapered tubes. One process which is commonly used to produce tapered tubes is rotary swaging. Rotary swaging is a process for reducing the cross-sectional area or otherwise changing the shape of bars, tubes, or wires by repeated radial blows with one or more pairs of opposed dies. Such swaging machines are generally large and heavy so that they can handle the large forces and vibrations associated with swaging. There are several problems which prevent swaging large diameter tubes from being practical. Not only is the machine required to swage large diameter tubes large and takes up a lot of space, it is difficult to produce lengthy large diameter tapered tubes of uniform wall thickness. Finally, to reduce the effects of work hardening and to prolong the service life of the swaging machine, rolls and backers used in the cold swaging process must be stress relieved periodically.

Another process used to produce tubes and pipe is roll forming. This process, however, cannot be easily modified to produce round tapered poles.

The following patents employ a variety of methods to produce round tapered tubes. None, however, utilize the Applicant's machine and process for forming round tapered pipe from flat sheet metal. U.S. Pat. No. 4,971,239, "Method and Apparatus for Making Welded Tapered Tubes," describes a process of taking a flat sheet of metal, bending it into a 'U' shape, bending the top together and welding it to form a tapered oval. The tapered oval is then formed into a tapered round tube by a tapered outside die. Although this patent utilizes pre-forming of the sheet before it is worked into a tapered tube, this process requires the use of large, expensive presses to form the 'U' and requires a series of fin rolls to deform the section into an oval shaped tapered tube.

U.S. Pat. No. 3,452,424, "Forming and Welding Tapered Tubes" uses the same ideas as the above patent. However, once the tapered oval is formed, this patent utilizes an inside mandrel which is forced into the inside of the tube to form the round tapered shape. This process also requires the use of large expensive equipment to form the 'U' and to force the mandrel into the tube.

U.S. Pat. No. 4,846,392, "Continuously Variable Speed, Die-Drawing Device and Process for Metal, Composites, and the Like, and Compositions Therefrom" describes an elaborate machine for producing tapered poles from a continuous sheet of rolled sheet metal. This machine is an extruding type device and the patent makes no mention of pre-forming the sheet.

U.S. Patent No. 3,920,173, "Method and Machine for Manufacturing Shaped Parts From Flat Sheet Metal," and U.S. Pat. No. 3,802,235 "Machine and Method for Forming Tapered Tubes," both describe a process in which a mandrel is employed to shape a trapezoidally cut sheet of metal.

U.S. Pat. No. 4,622,841, "Method of Forming Long Metal Tubing to Tapered Shape" and U.S. Pat. No. 3,802,240, "Device for the Conical Tapering of Circular Cross-sectioned Elongated Work Pieces" are both patents for a method and device for producing tapered tubes. However, each of these devices requires tubing or pipe as a work piece rather than flat trapezoidal sheets of metal.

SUMMARY OF THE INVENTION

It is therefore an object of the invention to provide a method for forming tapered or cylindrical poles from flat sheet metal which includes the steps of placing the sheet of metal in a die press, pressing the blank so that the sides are curled or pre-formed, taking the pre-formed blank and forming it into a tubular shape by use of a shovel die press, and welding the formed longitudinal seam. The term "shovel die" is used to describe a press wherein, the preformed blank slides and curls inside the opposing die faces like material does in a scoop shovel or a dozer blade.

An additional object is to provide a method for forming a round tapered pole from a piece of flat sheet metal which overcomes the aforementioned limitations of the prior art.

Another object is to produce tubes with a good exterior surface finish to provide an aesthetically pleasing tube as well as a strong tube.

A further object is to produce tapered round utility poles at the same rate or faster than present industrial equipment.

A yet further object in producing round tapered utility poles is to pre-form flat blanks to ensure that little or no buckling of the blank occurs when it is formed in a shovel die.

One advantage of the invention is that less force is needed to form the tube into its final tapered shape since the blanks are pre-formed. The fact that less force is required generally means the shovel die press experiences less wear and will, therefore, generally have a longer life.

A particular and specific object is to provide a method of making a tapered round utility pole from a length of trapezoidal metal sheet. The longitudinal sides or edges of the sheet are first pre-formed to inwardly facing curvatures by cold forming the sheet in a male/female press and die. The curvature of the pre-forming dies are of a radius $R_p$, such that spring-back of the pre-formed curl or curvature will result in the sheet having a radius of curvature of the final product, $R_d$.

Preferably, the pre-forming operation accounts for about one-third of the total forming process. The resulting pre-formed blank resembles a tapered trough which is then inserted and damped along its center longitudinal axis in a shovel die machine for final curling of the tube. The shovel die is formed of two facing tapered curved dies which are brought together by a plurality of hydraulic power cylinders. Once the two longitudinal edges of the pre-formed blank are brought together they can be held in place by the shovel die until the seam is welded.

DETAILED DESCRIPTION OF THE PREFERRED EMBODIMENTS

Figure 1:
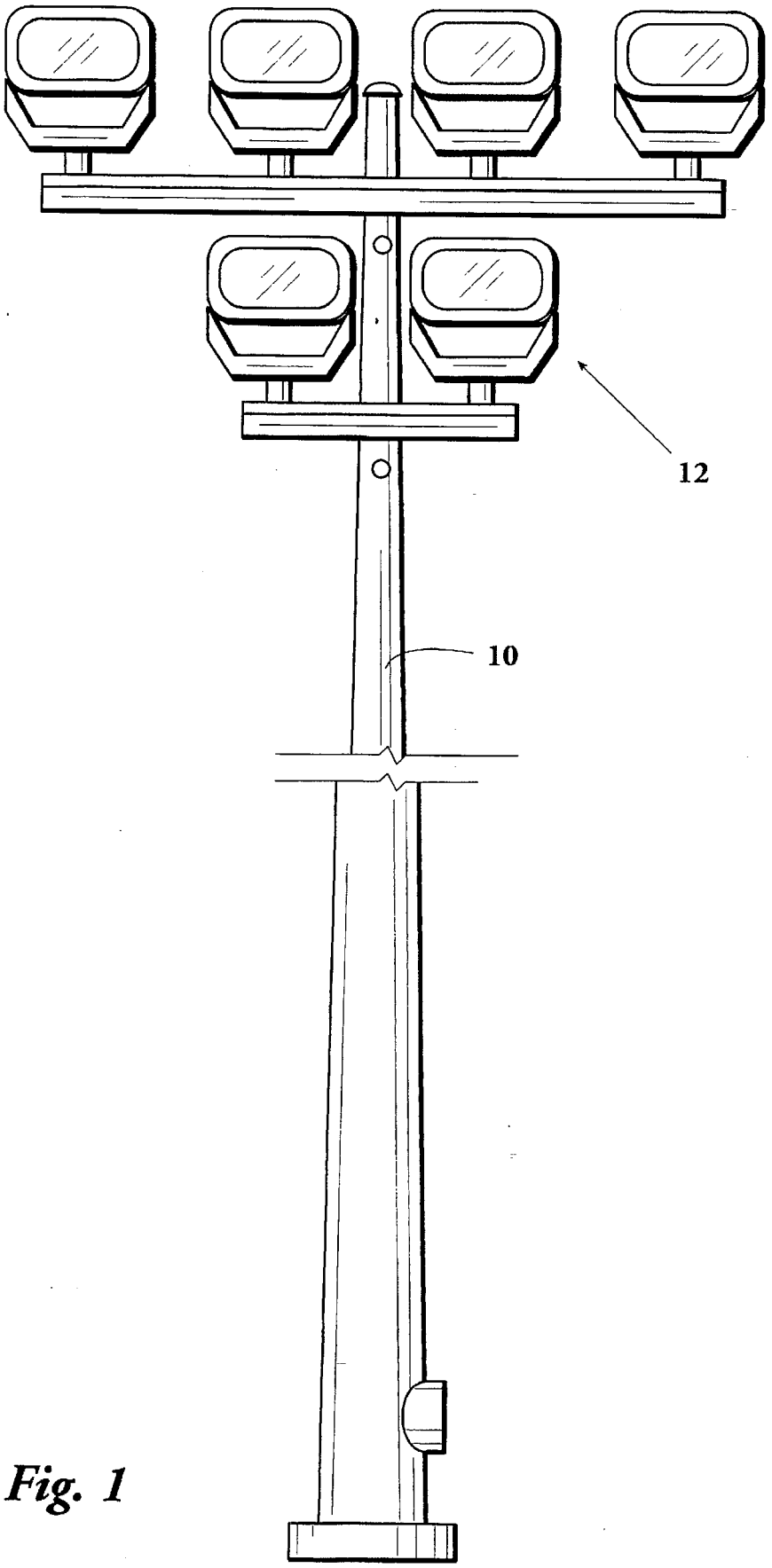
FIG. 1 is an elevation view of a round tapered pipe in use as a light pole.

FIG. 1 generally depicts a typical round tapered pole 10 being used in this instance to support stadium lights generally designated by the numeral 12. The invention herein is directed to a process and apparatus for forming the pole.

Figure 2:
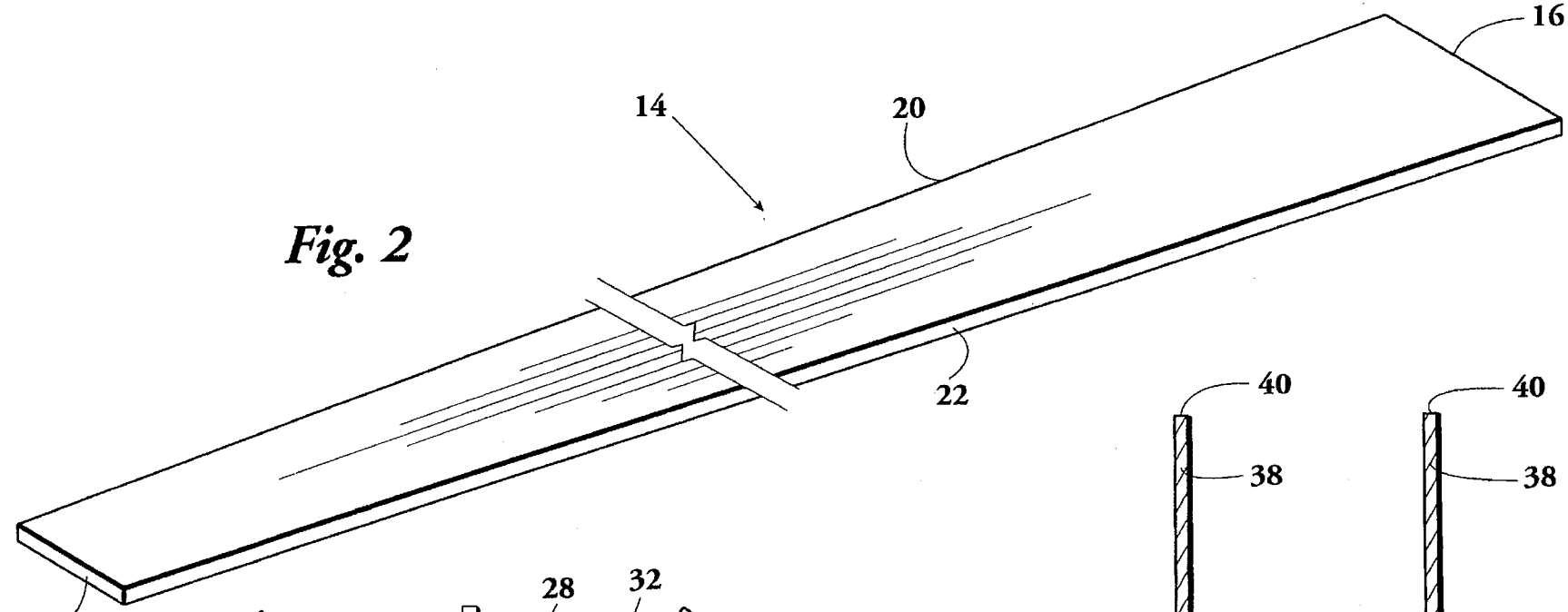
FIG. 2 is a perspective view of a trapezoidal blank.
Figure 4:
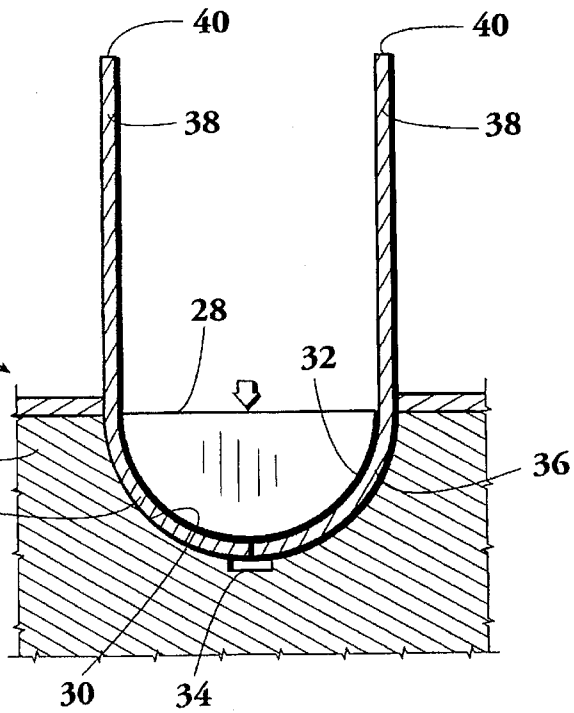
FIG. 4 shows a cross-sectional view of two pre-formed blanks interposed between the male and female die after one end has been acted upon by the male die.
Figure 3:
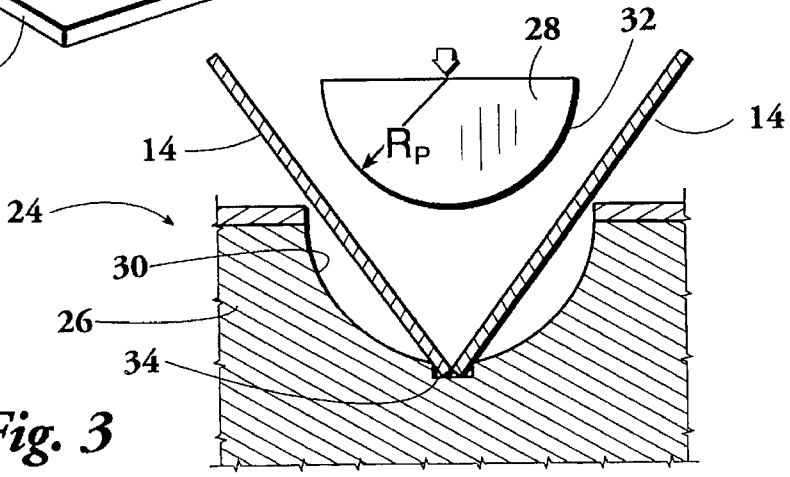
FIG. 3 is a cross-sectional view of two blanks interposed between the male and female pre-forming die before being acted upon by the male die.
Figure 11:
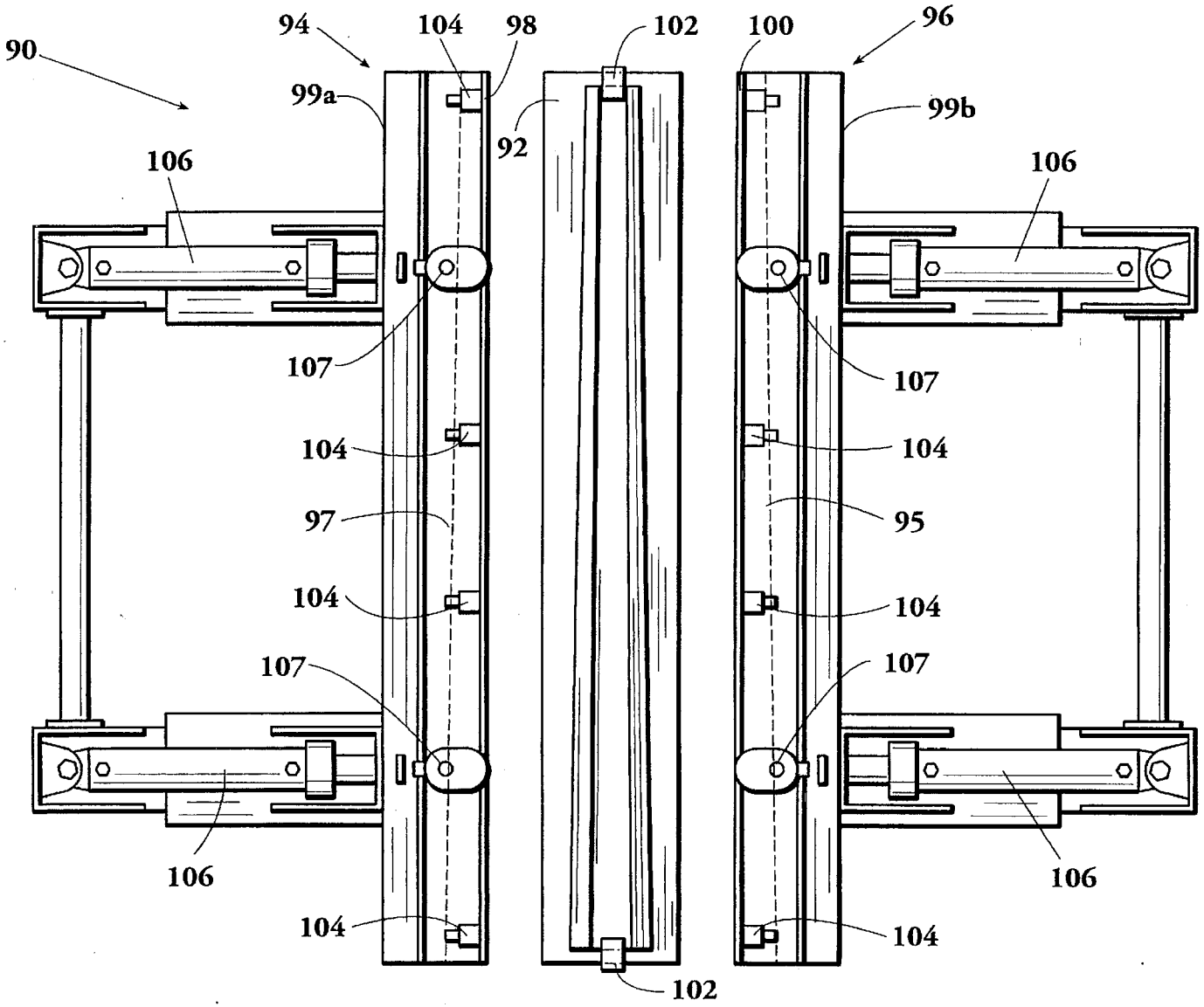
FIG. 11 is a plan view of the shovel die press in position to act upon the pre-formed trapezoidal blank.

An important aspect of this invention is the preforming of a trapezoidal blank, as shown flat in FIG. 2. A trapezoidal blank generally designated by the numeral 14 tapers from wide end 16 to narrow end 18, forming two longitudinal side edges, 20 and 22. A pair of trapezoidal blanks 14 are disposed on recessed area 34 of pre-forming female die 26 and are in position to be acted upon by male die 28 as shown in FIG. 3. Pre-forming female die 26 is constructed with a curved die surface 30 and pre-forming male die 28 is constructed with a curved die surface 32. The calculated pre-form radius $R_p$, of the curved die surfaces, 30 and 32, of the pre-forming dies 26 and 28 is based upon the predicted spring-back of the trapezoidal blank 14 after deformation. The calculated spring-back is a function of the material properties and the gauge of the metal of the blank 14. The radius of curvature of the longitudinal formed portion 36 of the partially pre-formed blanks 38, as shown in FIG. 4, is equal to the desired final radius of the pole $R_d$. A mathematical equation is used to calculate the radius of curvature of the curved die surfaces 30 and 32 of the pre-forming die 24. The theory which predicts the required curvature $R_p$ of the die surfaces 30 and 32 necessary to produce a pre-formed blank that has an unloaded radius of curvature that matches the desired curvature of the final tube $R_d$ is as follows:

$$R_p = \frac{R_d}{1 + \frac{3YR_d}{Et}}$$

where $R_p$=the pre-formed die radius $R_d$=the desired final radius of curvature of the blank t=the blank material thickness E=Young's modulus of the blank material Y=blank material yield strength The radius of curvature $R_p$ of the two halves of the pre-forming press 24 is a function of the desired final radius $R_d$ which is equal to the radius of curvature of the shovel die press 90 shown in FIG. 11. The shovel die press 90 is used in the final forming phase. The longitudinal side edges 20 and 22 of the trapezoidal blank 14 are pre-curled or formed in the pre-forming press 24 in such a way that typically about 16% of the width of the blank, for its entire length, is bent to a pre-formed radius of curvature $R_p$ which is less than that of the radius of curvature of the finished tube, $R_d$. The remainder of the tube is later formed by the shovel die press 90. During the pre-forming process, the metal in the trapezoidal blank 14 undergoes both elastic and plastic deformations. When the pre-forming loads have been removed, the metal experiences some elastic recovery known as "spring-back". The pre-formed die radius $R_p$ is smaller than the desired final radius $R_d$ to compensate for the "spring-back" of the pre-formed blank 42.

Figure 9:
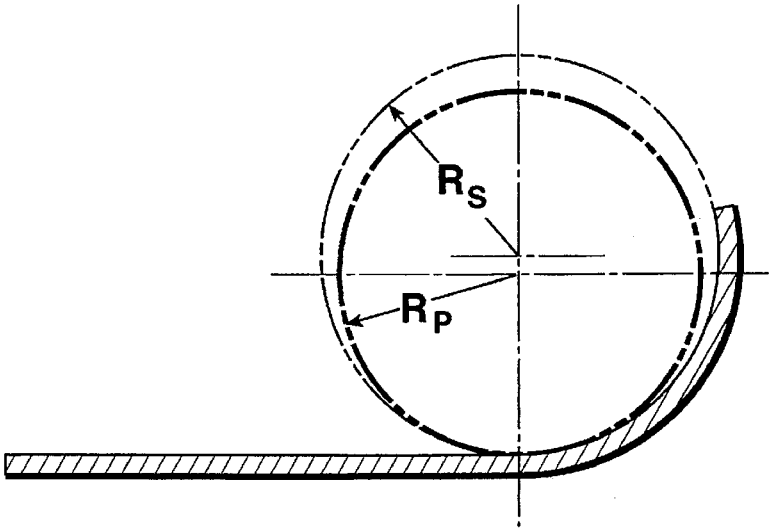
FIG. 9 is a pre-formed blank shown relative to the blank's pre-formed and spring back radii of curvature.

The "spring-back" of the pre-formed trapezoidal blank 42 is illustrated in FIG. 9. The pre-formed die radius $R_p$ is smaller than the calculated "spring-back" radius $R_s$, which is equal to the desired final radius $R_d$ of the pre-formed blank 42.

Figure 5:
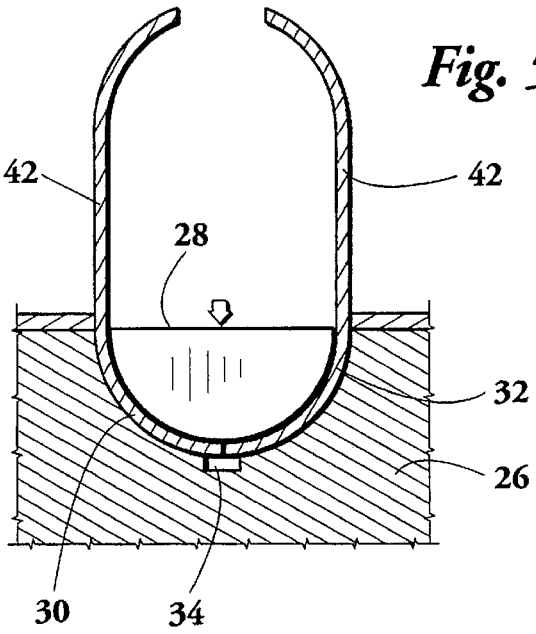
FIG. 5 is a cross-sectional view of two pre-formed blanks interposed between the male and female die after both ends of the blanks have been acted upon by the male die.
Figure 16:
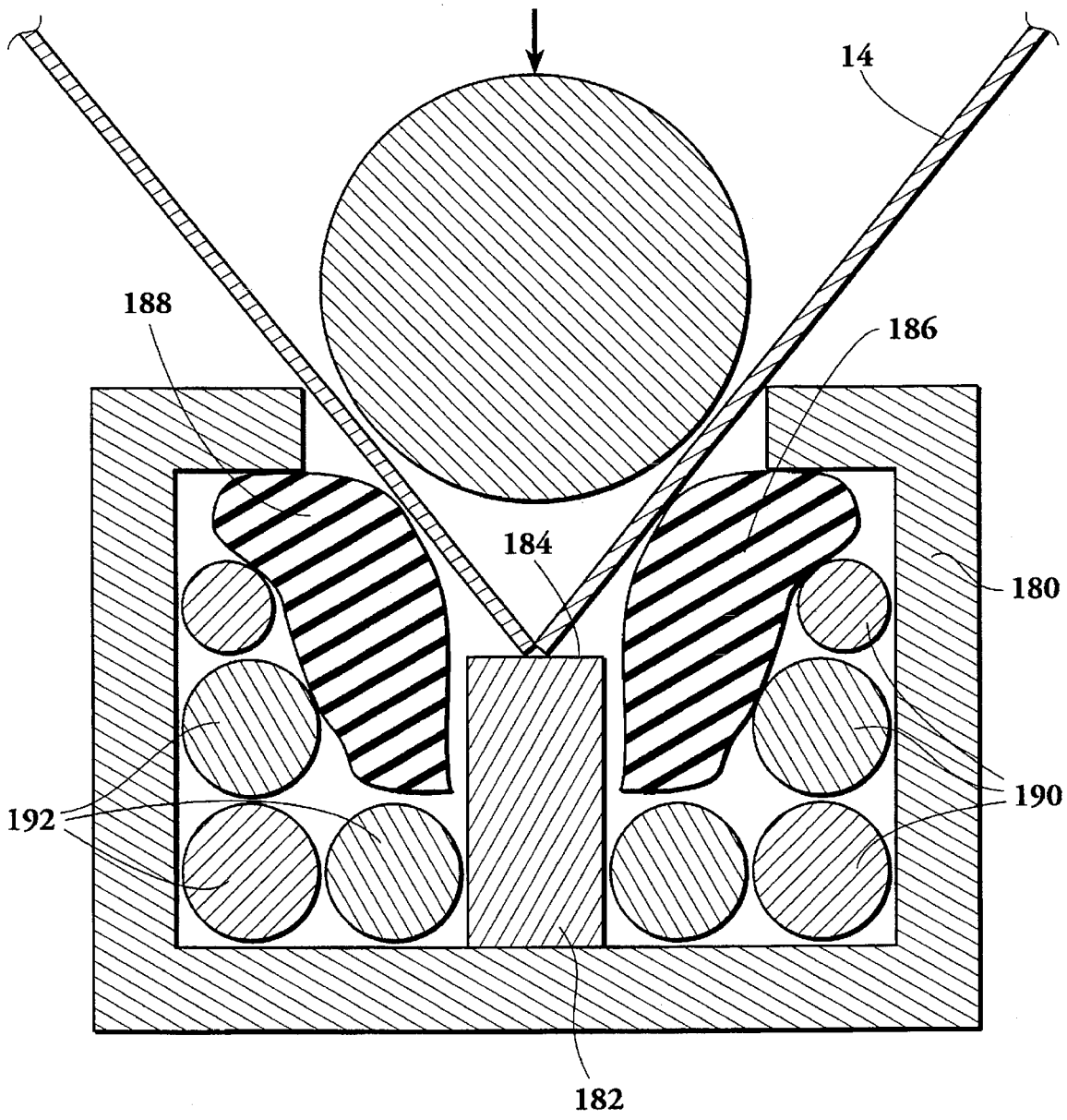
FIG. 16 is a sectional view of another form of preforming die.

A pair of pre-formed blanks 42 are shown in FIG. 5. The steps required for forming the pre-formed blanks 42 are as follows: First, the trapezoidal blanks 14 are placed in alignment notch 34 on the female die 26 as shown in FIGS. 3, 4, 5 and 6. This notch merely serves to assure the blanks are lined up for the pre-forming process. The advantage of forming two blanks at the same time is that the large lateral forces are cancelled since the dies and blanks are positioned symmetrically. The male die 28 then presses the trapezoidal blanks 14 which forms or curls the longitudinal side edges 20 of two blanks simultaneously, resulting in partially pre-formed blanks 38 as shown in FIG. 4. The male die 28 is then retracted, and the partially pre-formed blanks 38 are removed and reinserted with the longitudinal non-formed ends 40 placed in recessed area 34. Finally, the male die 28 presses the partially pre-formed blanks 38 which results in the pre-formed blanks 42 depicted in FIG. 5. The pre-forming could also be done by using a rubber die such as shown in FIG. 16. In that embodiment, the die is formed of die box or framework 180 with a metal die 182 having an upper flat surface 184. Interiorly of the framework 180 are rubber die blocks 186 and 188 which are backed up by a plurality of steel rods or bars 190 and 192. As the male die 194 comes down the rubber, dies 186 and 188 are compressed, thus forcing the blank against the die. The steel bars 190 and 192 are necessary to control the expansion of the rubber die blocks. The bottom metal die serves to bend the edge of the blank around the male die. The advantage of this is that the die is much less expensive to build.

Figure 6:
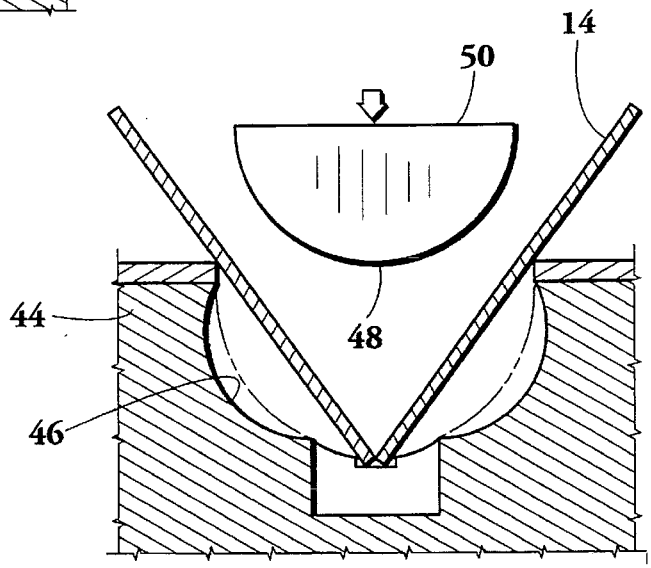
FIG. 6 is a cross-sectional view of an alternate embodiment of the male and female dies.

The shape of the female die of the pre-forming press is less critical than the shape of the male die. Consequently, the curved die surface 46 of the female die 44 need not correspond exactly to the curvature of the curved die surface 48 of the male die 50 as shown in FIG. 6, except at the edge of the blanks.

Figure 7:
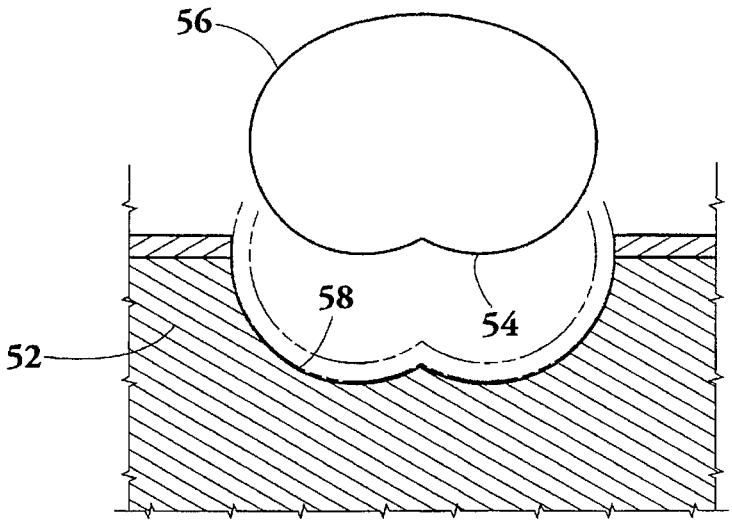
FIG. 7 is a cross-sectional view of a further embodiment of a male and female die.

Additionally, variations in the die shape are possible to enhance the ability to bend the trapezoidal blanks at their extreme edges. The female cardioid shaped die 52 and male cardioid shaped die 56, as shown in FIG. 7, possess curved die surfaces 54 and 58 designed to more easily bend the longitudinal edges 20 and 22 of the trapezoidal blanks 14.

Figure 8:
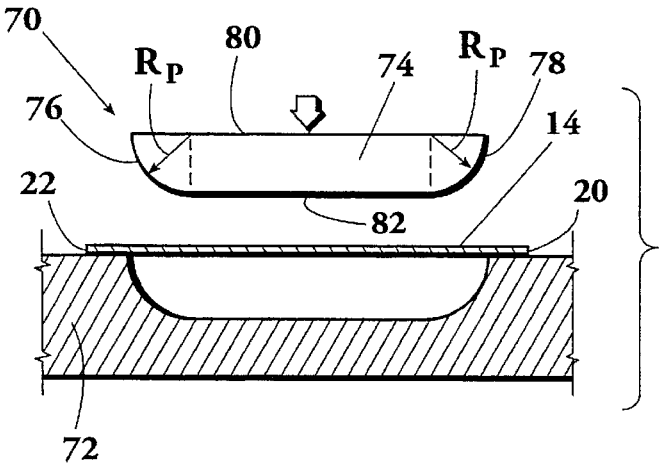
FIG. 8 is a cross-sectional view of a still further embodiment of the male and female dies with a single blank shown interposed between the male and female die.

A further alternate embodiment is the pre-forming press 70 shown in FIG. 8. This embodiment of the pre-forming press forms both longitudinal sides 20 and 22 of a single trapezoidal blank 14 simultaneously. The female die 72 is shown supporting a single trapezoidal blank 14. The pre-forming male die 74 is shown in position to press the trapezoidal blank 14 into the female die 72. The radius of the male curved die surfaces 76 and 78 on each end of the pre-forming male die 74 are calculated in the same manner as was used to calculate the radius of the male curved die surface 32 shown in FIGS. 4 and 5. A typically flat inside span 82 separates the two male curved die surfaces 76 and 78. The width of the inside span 82 is determined by calculations based on the width of trapezoidal blank 14 and the arc length of each of the male curved die surfaces 76 and 78. The width of the inside span 82 is determined by calculations based on width of trapezoidal blank 14 and the arc length of each of the male curved die surfaces 76 and 78. The width of the inside span 82 is calculated using the following equation:

$$W_i = W - 2_s$$

where $W_i$=the length of inside span 82

W=the width of the blank 14

S=the arc length of the forming regions 76 and 78

The pre-forming press 70 operates on one blank 14 at a time and forms both longitudinal side edges 20 and 22 simultaneously.

Figure 10:
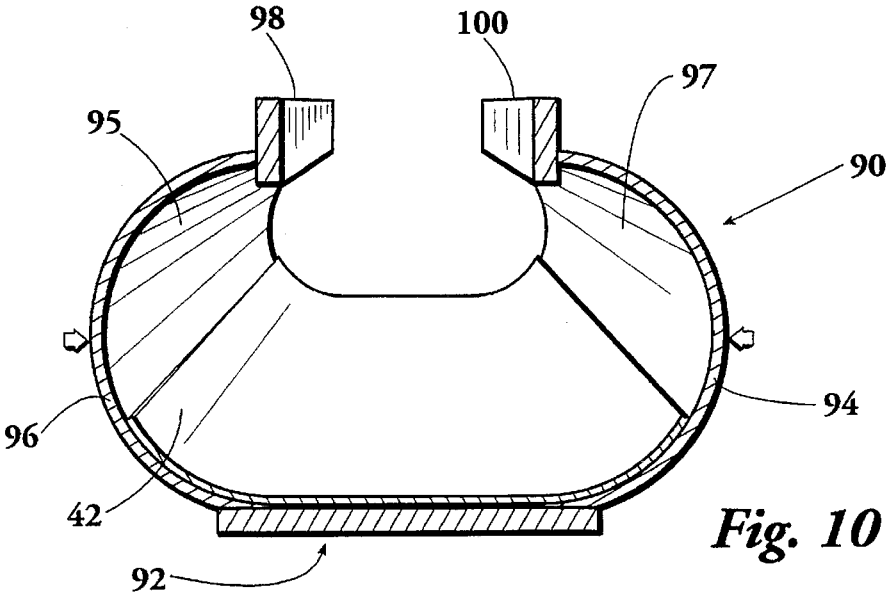
FIG. 10 is a shovel die press with a pre-formed blank in place.

FIG. 10 is the lateral press, termed hereafter the "shovel die press", designated generally 90, where the final forming is done. The pre-formed blank 42 is on the platen 92 between the two halves of the shovel die press 90. The two halves of the shovel die press 90 are made up of split conical dies 94 and 96 that are forced together to form the pre-formed blank 42 into a formed tube (not shown). The split conical dies 94 and 96 are mounted on pusher beams 99*a* and 99*b* that are acted upon by hydraulic cylinders 106 as shown in FIG. 11. The movement of split conical dies 94 & 96 can be controlled by a computer (not shown). Load cells are used to measure the force of each hydraulic cylinder 106. The computer operates a control valve which controls movement of the dies 94 & 96 at the end of each stroke; i.e. just before the dies come together to form a cylinder. As the split conical dies 94 and 96 are forced together by hydraulic cylinders 106 and track along slider beams 101, the pre-formed blank 42 slides across the surfaces of the split conical dies 94 and 96. The surfaces of the dies 94 and 96 are lubricated so as to prevent the scratching of the surface of the pre-formed blank 42. As the two split conical dies 94 and 96 come together, the pre-formed blank 42 will typically slide in one half of the die or the other. In one embodiment, a set of stops or edge fingers 98 and 100, as shown in FIG. 10, are provided to restrain the pre-formed blank 42 which otherwise might slide around the entirety of the inner surfaces of split conical dies 94 and 96. When the sliding of the pre-formed blank 42 has been arrested by the edge fingers 98 or 100, the non-sliding longitudinal side 20 or 22 is forced to slide and will continue to slide around the inner surface of the die until the pre-formed blank 42 contacts the non-engaged edge finger 98 or 100. The edge finger 98 or 100 provides a stop so that the longitudinal sides 20 and 22 of the pre-formed blank 42 are positioned adjacent to the gap between the two split conical dies 94 and 96 of the shovel die press 90 when it is substantially closed. When the shovel die press 90 is substantially closed, the edge fingers 98 and 100 are retracted and the shovel die 90 is then fully closed, forcing the pre-formed blank 42 into formed tube 108 and forming a seam between the two longitudinal sides 20 and 22. As the split conical dies 98 and 100 are forced into a closed position by the hydraulic cylinders 106, the force on the seam increases to the point that the pre-formed blank 42 is forced into intimate contact with all inner surfaces of the conical dies 94 and 96 and any geometric irregularities in the resulting tube are forced out.

Figure 12:
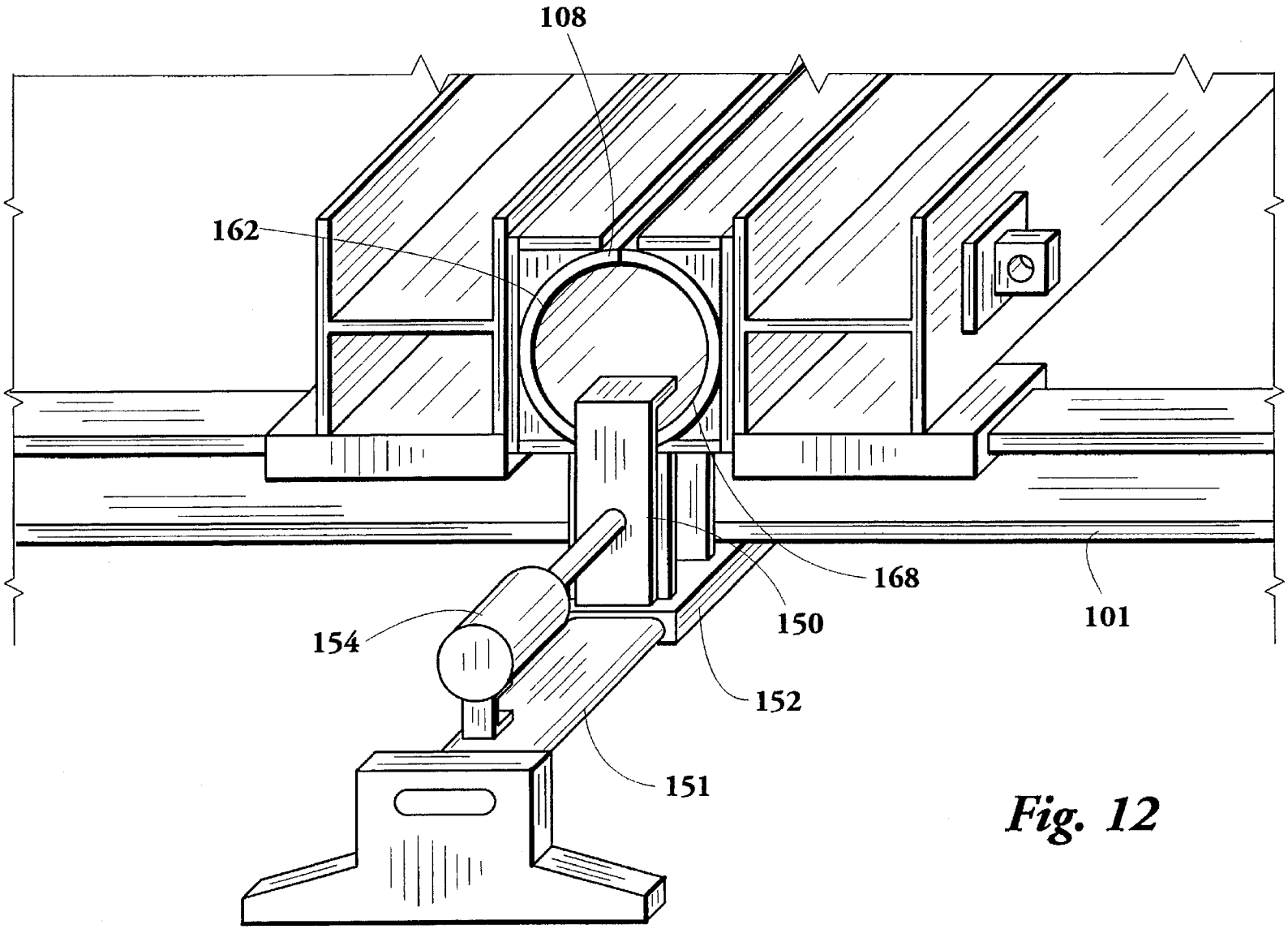
FIG. 12 is a perspective view of the formed tube in the shovel die press being held by one form of damp.
Figure 14:
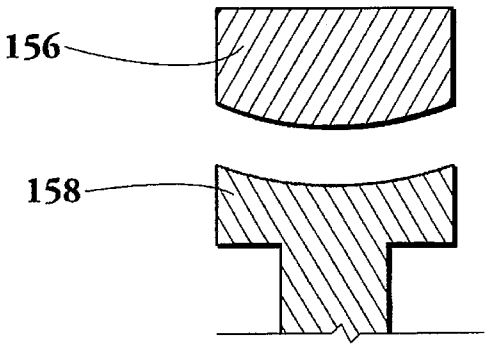
FIG. 14 is a cross-sectional view of the jaws of the clamp.
Figure 13:
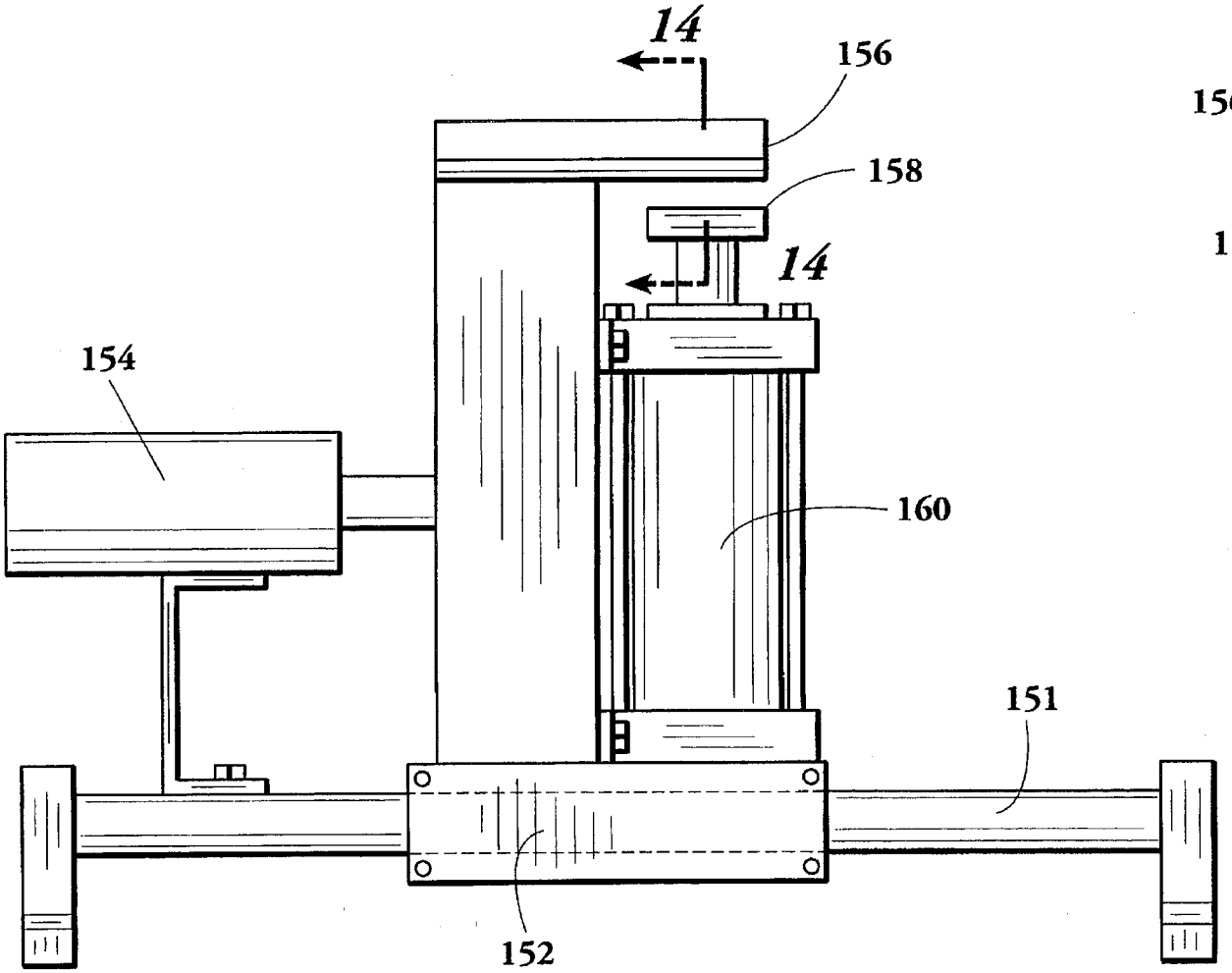
FIG. 13 is an elevation view of the clamp.

Several variations of the shovel die press are possible. One variation is to eliminate the edge fingers 98 and 100 mounted on split conical dies 94 and 96 and secure the pre-formed blank 42 in position by use of clamp 150 as shown in FIG. 12. Clamp 150 prevents the pre-formed blank 42 from moving horizontally inside the die. The clamped pre-formed blank 42 then slides around and is deformed by both sides of the split conical dies 162 and 164 simultaneously.

Clamp 150 is mounted on slider 152. Air cylinder 154 moves clamp 150 along slider beam 151 to a position to clamp the pre-formed blank 42 and secure it such that the blank does not slide within the shovel die. After the shovel die operation is complete, and the tube 108 is created, the longitudinal seam is welded in place. Thereafter, the air cylinder 154 retracts the clamp 150 and the pole released from the shovel die.

The clamp 150 is comprised of curved upper clamping jaw 156 and curved lower clamping jaw 158. The vertically movable lower clamping jaw 158 is acted upon by hydraulic cylinder 160 to clamp the blank.

Figure 15:
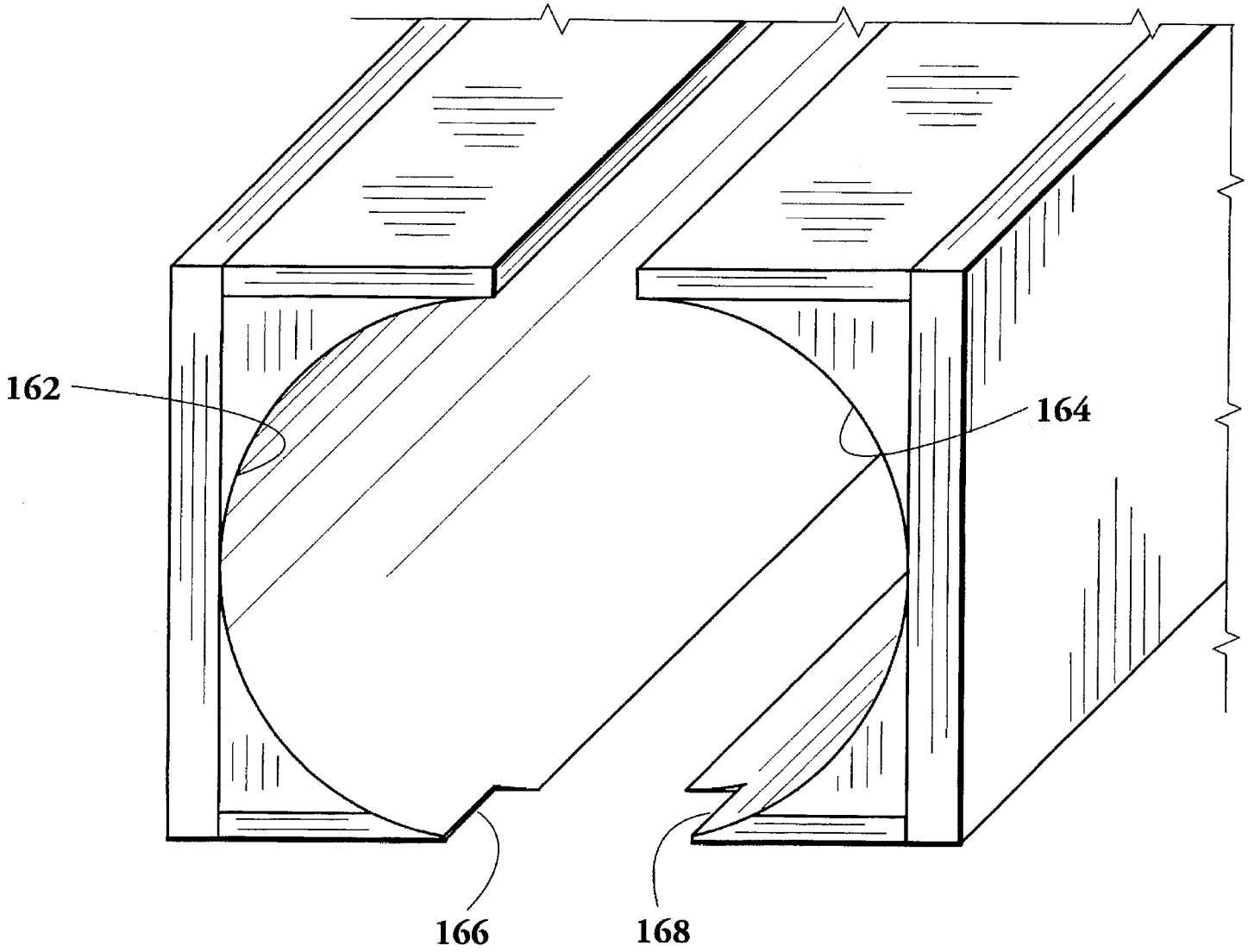
FIG. 15 is a perspective view of the shovel die press with recessed areas to accommodate the clamp.

The conical die halves 162 and 164, used in the embodiment utilizing clamp 150, are equipped with notches 166 and 168 to accommodate clamp 150, as shown in FIG. 15.

A further alternate embodiment is to hold the pre-formed blank 42 in place by use of a vertical ram or other type of actuator. The ram, like the aforementioned clamp 150, restricts horizontal movement of the pre-formed blank 42 and causes sliding to occur in both halves of the die simultaneously. The ram is retracted when the blank has been forced all the way around the die and the shovel press 90 is substantially closed.

The above processes of pre-forming the blank and forming the pre-formed blank into a tube could be combined into one machine. For example, the pre-forming press could be mounted over the shovel die press, so that the blank would not have to be transported between the machines.

An additional alternate embodiment is to provide removable sections of the shovel die press 90 adjacent to the opening in between the shovel die halves 94 and 96. The removable sections would provide access to the seam formed by the tubular shaped metal sheet for welding purposes.

Referring to FIG. 11, shown is a plan view of a shovel die press designated generally 90. Visible are the two halves of the shovel die press designated generally 94 and 96. The formed tube 108 is shown resting on the platen 92. The hydraulic cylinders 106 force the two halves of the shovel die 94 and 96 together. The inner surfaces 95 and 97 of the two halves of the shovel die press 94 and 96 are tapered to produce conical tubes. The edge fingers 98 are positioned at the upper edge of the shovel die halves 94 and 96 and are slidably connected to finger guides 104. A pair of hydraulic edge finger retractors 107 mounted on top of each shovel die half 94 and 96, serve to raise and lower the edge fingers 98 when the shovel die halves 94 and 96 are forced together or pulled apart by hydraulic cylinders 106.

The final step in the process involves welding the longitudinal seam on the formed tube 108. This can be done by several processes and can be done within the shovel die machine, if retractable die sections were to be employed. A second variation would be to provide welding ports in the upper surface of the shovel die halves 94 and 96 to stitch the edges together which would make the subsequent alignment and welding in an external frame much easier.

Whereas, the present invention has been described in relation to the drawings attached hereto, it should be understood that other and further modifications, apart from those shown or suggested herein, may be made within the spirit and scope of this invention.

What is claimed is:

1. A method for forming tapered or cylindrical pipe comprising the steps of:

operatively positioning a pair of trapezoidal blanks of metal in a pre-forming press, each of said blanks having a wide end, a narrow end, and longitudinal sides;

said press being comprised of a male die having a first and a second side which is forced into a female die, said trapezoidal blanks inserted in between said male and female die at said first and second side of said male die pressing said blanks in said press to preform said longitudinal sides whereby each of said trapezoidal blanks is transformed into a tapered trough with curled longitudinal sides;

applying an inward force to said curled longitudinal sides of one of said blanks such that said longitudinal sides are brought into proximity with one another; and welding said longitudinal sides to form a longitudinal seam.

2. A method for forming tapered or cylindrical pipe comprising the steps of:

operatively positioning a trapezoidal blank of metal in a pre-forming press, said blank having a wide end, a narrow end, and longitudinal sides;

pressing said blank in said press, using a hydroformer, to preform said longitudinal sides whereby said trapezoidal blank is transformed into a tapered trough with curled longitudinal sides;

applying an inward force to said curled longitudinal sides of one of said blanks such that said longitudinal sides are brought into proximity with one another; and welding said longitudinal sides to form a longitudinal seam.

3. A method for forming tapered or cylindrical pipe comprising the steps of:

operatively positioning a pair of trapezoidal blanks of metal in a pre-forming press, said press having a male and a rubber sided female die, each of said blanks having a wide end, a narrow end, and longitudinal sides;

pressing said blanks in said press to preform said longitudinal sides whereby each said trapezoidal blank is transformed into a tapered trough with curled longitudinal sides;

applying an inward force to said curled longitudinal sides of one of said blanks such that said longitudinal sides are brought into proximity with one another; and welding said longitudinal sides to form a longitudinal seam.

4. A method for forming tapered or cylindrical pipe comprising the steps of:

operatively positioning a trapezoidal blank of metal in a pre-forming press having male and female dies, said blank having a wide end, a narrow end, and longitudinal sides;

pressing said blank in said press to preform said longitudinal sides whereby said trapezoidal blank is transformed into a tapered trough with curled longitudinal sides, a radius of curvature of the male and female dies being such that after preforming, a spring-back curvature of the formed portion of said sheet is equal to the final curvature of said pipe;

applying inward force to said curled longitudinal sides such that said longitudinal sides are brought into proximity with one another, applying inward force to said curled longitudinal sides such that said longitudinal sides are brought into proximity with one another; and welding said longitudinal sides to form a longitudinal seam.

5. A method for forming tapered or cylindrical pipe according to claim 4 wherein the radius of curvature of said pre-forming press is determined by calculations made by using the equation:

$$R_p = \frac{R_d}{1 + \frac{3YR_d}{Et}}$$

where $R_p$=the pre-formed die radius $R_d$=the desired final radius or curvature of the blank t=the blank material thickness E=Young's modulus of the blank Y=blank material yield strength.

6. A method for forming tapered or cylindrical pipe comprising the steps of:

operatively positioning a trapezoidal sheet of metal in a prforming die, said sheet having a wide end, a narrow end, and longitudinal sides;

pressing said sheet in said die to pre-form said longitudinal sides whereby said trapezoidal blank is transformed into a tapered trough with curled longitudinal sides;

applying inward force to said curled longitudinal sides such that said longitudinal sides are brought into proximity with one another; and welding said longitudinal sides to form a longitudinal seam;

wherein said curling or pre-forming results in deformation of about 16% of the width of the blank, for its entire length, said blank being bent to a radius of curvature less than that of the finished tube.

7. A method for forming tapered or cylindrical pipe comprising the steps of:

operatively positioning a trapezoidal sheet of metal in a preforming die; said sheet having a wide end, a narrow end, and longitudinal sides;

pressing said sheet in said die to preform said longitudinal sides whereby said trapezoidal blank is transformed into a tapered trough with curled longitudinal sides;

applying inward force to said curled longitudinal sides with a shovel die press having opposite conical dies to receive said tapered trough;

means to force said opposite conical dies inwardly such that said longitudinal sides are brought into proximity with one another, said inward force; and welding said longitudinal sides to form a longitudinal seam.

8. A method for forming tapered or cylindrical pipe according to claim 7 wherein at the top of each conical die is a retractable finger to restrain said blank.

9. A method for forming tapered or cylindrical pipe according to claim 7 further comprising the step of restraining said pre-formed blank relative to said conical dies to prevent lateral movement within the shovel die.

10. A method for forming tapered or cylindrical pipe according to claim 9 wherein said means to secure said pre-formed blank is a clamp.

11. A method for forming tapered or cylindrical pipe according to claim 7 wherein said shovel die press is equipped with removable die sections to provide access to said longitudinal seam for welding.

12. A method for forming tapered or cylindrical pipe comprising the steps of:

operatively positioning a trapezoidal sheet of metal in a preforming die, said sheet having a wide end, a narrow end, and longitudinal sides;

pressing said sheet in said die to pre-form said longitudinal sides whereby said trapezoidal blank is transformed into a tapered trough with curled longitudinal sides;

applying inward force to said curled longitudinal sides such that said longitudinal sides are brought into proximity with one another; and welding said longitudinal sides to form a longitudinal seam;

wherein said curling or pre-forming of said trapezoidal blank is accomplished by use of a pre-forming press and said forming of said pre-formed blank is accomplished by a shovel die press, said pre-forming press and said shovel die press combined into one machine.

13. Apparatus for forming tapered round poles, comprising:

a support base;

first and second opposed shovel dies slideably supported upon said base, each of said dies facing each other and tapered and concave in curvature to approximately the desired resulting curvature of the pole;

means to clamp a longitudinal and trapezoidal metal blank to said support base between said shovel dies, said blank being pre-formed along longitudinal sides to a curvature substantially the same as said curvature of said shovel dies;

means to move each of said shovel dies toward each other and thereby forming said tapered round pole with a single longitudinal abutment of said longitudinal sides.

14. Apparatus of claim 13 wherein a top edge of said shovel dies includes a retractable longitudinal finger to restrain said blank as it curls toward the top of said shovel dies as said dies move toward each other.

15. Apparatus of claim 13 wherein said means to move comprises a plurality of hydraulic power means.

16. A method for forming tapered or cylindrical pipe comprising the steps of:

(a) operatively positioning a pair of trapezoidal blanks of metal in a preforming press, each of said blanks having a wide end, a narrow end, and first and second longitudinal sides and edges;

(b) positioning said blanks in a female die having a first and a second curved sides such that said first longitudinal edges of each blank are centrally abutted within said female die;

(c) pressing a male die against said blanks to create a preformed curvature in said first longitudinal sides of each blank;

(d) repeating steps (b) and (c) to create a preformed curvature of said second longitudinal sides of each blank whereby each of said trapezoidal blanks is transformed into a tapered trough with curled longitudinal sides;

(e) applying an inward force to said curled longitudinal sides of one of said blanks such that said longitudinal sides are brought into proximity with one another; and (f) welding said longitudinal sides to form a longitudinal seam.

17. The method for forming tapered or cylindrical pipe according to claim 16 wherein said trapezoidal blanks angularly rest in a form of a V toward said first and second side of said female die.

18. A method for forming tapered or cylindrical pipe according to claim 16 wherein said trapezoidal blanks are pre-formed by using a hydroformer.

19. A method for forming tapered or cylindrical pipe according to claim 16 wherein said trapezoidal blanks are pre-formed by using a rubber lined female die.

20. A method for forming tapered or cylindrical pipe according to claim 16 wherein, a radius of curvature of the male and female dies is such that after pre-forming, a spring-back curvature of the formed portion of said blank is equal to the final curvature of said pipe.

21. A method for forming tapered or cylindrical pipe according to claim 20 wherein the radius of curvature of said pre-forming press is determined by calculations made by using the equation:

$$R_p = \frac{R_d}{1 + \frac{3YR_d}{Et}}$$

where $R_p$=the pre-formed die radius $R_d$=the desired final radius or curvature of the blank t=the blank material thickness E=Young's modulus of the blank Y=blank material yields strength.

22. A method for forming tapered or cylindrical pipe according to claim 16 wherein said pre-forming curl results in deformation of about 16% of the width of the blank along each said longitudinal side along for its entire length.

23. A method for forming tapered or cylindrical pipe according to claim 16 wherein applying said inward force is accomplished by a shovel die press having opposite conical dies to receive said tapered trough and means to force said opposite conical dies inwardly.

24. A method for forming tapered or cylindrical pipe according to claim 23 wherein at the top of each conical die is a retractable finger to restrain said blank.

25. A method for forming tapered or cylindrical pipe according to claim 23 further comprising the step of restraining said pre-formed blank relative to said conical dies to prevent lateral movement within the shovel die.

26. A method for preforming trapezoidal blanks used to produce tapered or cylindrical pipe comprising the steps of:

(a) preparing a pair of trapezoidal metal blanks, each having a wide end, a narrow end, and first and second longitudinal sides and edges;

(b) positioning said blanks in a female die having a first and a second curved sides such that said first longitudinal edges of each blank are centrally abutted within said female die;

(c) pressing a male die against said blanks to create a preformed curvature in said first longitudinal sides;

(d) repeating steps (b) and (c) to create a preformed curvature of said second longitudinal sides of each blank whereby each of said trapezoidal blanks is transformed into a tapered trough with curled longitudinal sides.

27. The method for preforming according to claim 26 wherein said trapezoidal blanks angularly rest one against said first side and the other against said second side of said female die.

28. A method for preforming according to claim 26 wherein said trapezoidal blanks are pre-formed by using a hydroformer.

29. A method for preforming according to claim 26 wherein said trapezoidal blanks are pre-formed by using a rubber lined female die.

30. A method for preforming according to claim 26 wherein, a radius of curvature of the male and female dies is such that after pre-forming, a spring-back curvature of the formed portion of said blank is equal to the final curvature of said pipe.

31. A method for forming tapered or cylindrical pipe according to claim 30 wherein the radius of curvature of said pre-forming press is determined by calculations made by using the equation:

$$R_p = \frac{R_d}{1 + \frac{3YR_d}{Et}}$$

where $R_p$=the pre-formed die radius $R_d$=the desired final radius or curvature of the blank t=the blank material thickness E=Young's modulus of the blank Y=blank material yields strength.

32. A method for forming tapered or cylindrical pipe according to claim 26 wherein said pre-forming curl results in deformation of about 16% of the width of the blank along each said longitudinal side along for its entire length.

* * * * *

UNITED STATES PATENT AND TRADEMARK OFFICE

CERTIFICATE OF CORRECTION

PATENT NO. : 5,657,922

DATED : August 19, 1997

INVENTOR(S) : Lowery, et al.

It is certified that error appears in the above-identified patent and that said Letters Patent is hereby corrected as shown below:

On the title page, insert item [73] Assignee: The Board of Regents of Oklahoma State University, Stillwater, OK.

Column 1, line 5, insert the following:
— This invention was made with Government support under DOE contract No. DE-FG02-90ER45432 awarded by the Department of Energy. The Government has certain rights in this invention--

COL. 8, line 12 of claim 4, "sheet" should —blank--

COL. 9, lines 7, 16, and 17 of claim 6, "blank" should be —sheet--

COL. 9, line 7 of claim 7, "blank" should be —sheet--

COL. 10, lines 7, 16 and 17 of claim 12, "blank" should be --sheet—

Column 8, lines 59-61 is a repetition of the Column 8, lines 55-57 and should be deleted.

Signed and Sealed this

Fourteenth Day of April, 1998

Bruce Lehman

*Attest:*

BRUCE LEHMAN

*Attesting Officer*

*Commissioner of Patents and Trademarks*